US005613314A

United States Patent [19]

Leverenz et al.

[11] Patent Number: 5,613,314

[45] Date of Patent: Mar. 25, 1997

[54] COLLAPSIBLE BILLBOARD SIGN

[75] Inventors: Clifford W. Leverenz, Orland Park, Ill.; Jamshed R. Cooper, Plymouth, Minn.; Stephen P. Sohm, Robbinsdale, Minn.; Jehangir E. Rudina, Apple Valley, Minn.; Steven C. Larson, Minneapolis, Minn.

[73] Assignee: Minnesota Mining and Manufacturing Company, St. Paul, Minn.

[21] Appl. No.: 404,979

[22] Filed: Mar. 16, 1995

[51] Int. Cl.[6] ..... G09F 15/00

[52] U.S. Cl. ..... 40/610; 40/601; 160/207

[58] Field of Search ..... 40/610, 601, 529; 160/207, 206, 84.06, 199

[56] References Cited

U.S. PATENT DOCUMENTS

| | | | |
|---|---|---|---|
| 1,978,234 | 10/1934 | Stevens | 160/207 X |
| 2,234,685 | 3/1941 | Vance | 160/84.06 X |
| 2,679,444 | 5/1954 | Bennett | 160/207 X |
| 2,746,187 | 5/1956 | Ennever | 40/125 |
| 3,080,668 | 3/1963 | Reali | 40/36 |
| 3,757,845 | 9/1973 | Pagliaro | 160/207 X |
| 4,503,631 | 3/1985 | Kelly | 40/602 |
| 4,547,014 | 10/1985 | Wicker | 160/84.06 X |
| 4,631,849 | 12/1986 | Jeffery | 40/610 |
| 4,754,566 | 7/1988 | Gordon | 40/603 |
| 5,142,804 | 9/1992 | Hillstrom et al. | 40/603 |

*Primary Examiner*—Kenneth J. Dorner
*Assistant Examiner*—Cassandra Davis
*Attorney, Agent, or Firm*—Gary L. Griswold; Walter N. Kirn; Warren R. Bovee

[57] ABSTRACT

A collapsible sign, including a fixed frame, a plurality of sections hingedly and movably attached to the frame, the sign being movable the sections between a viewing position and a collapsed position. Adjacent pairs of the plurality of sections are positioned to provide an offset distance between axes of rotation located at each end of each section when the plurality of sections are in the viewing position.

22 Claims, 10 Drawing Sheets

Fig.4A
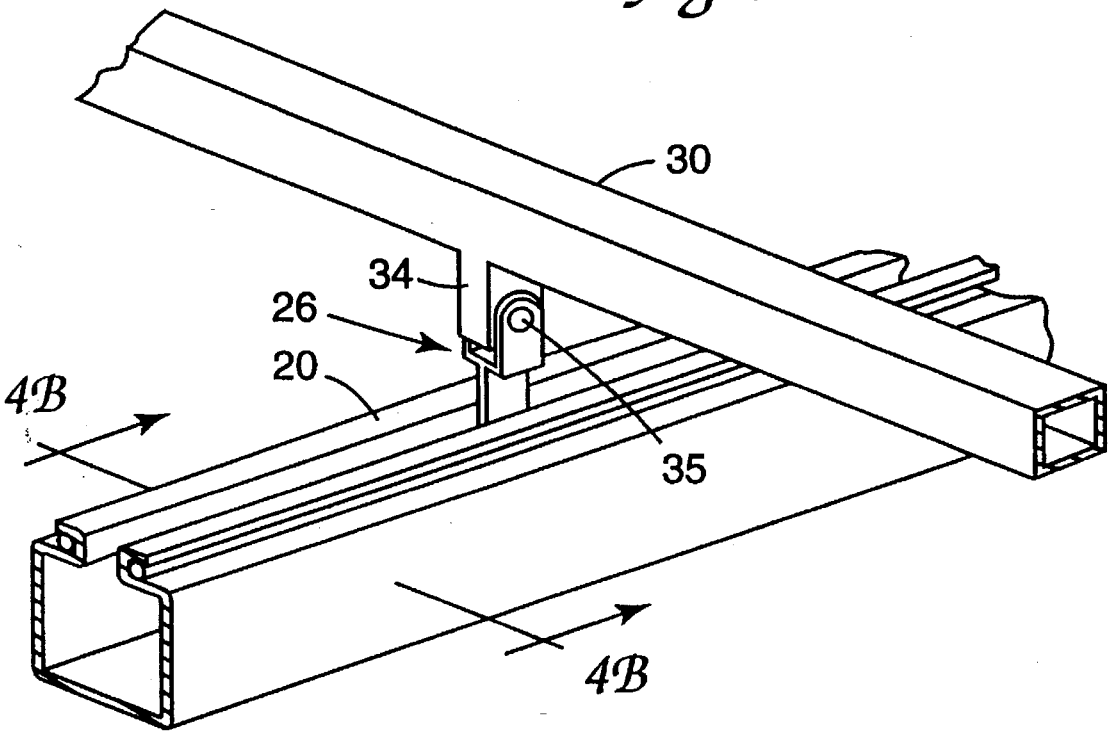
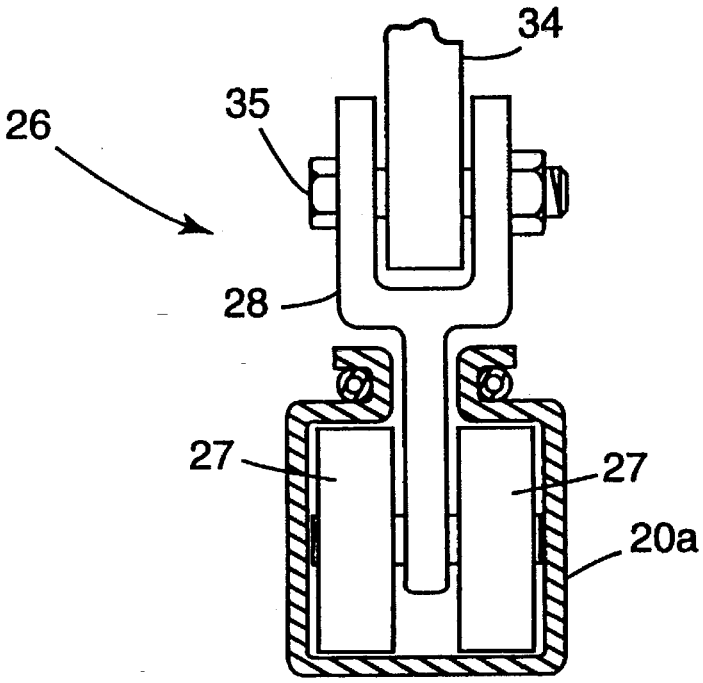
Fig.4B

COLLAPSIBLE BILLBOARD SIGN

FIELD OF THE INVENTION

The present invention relates to the field of billboard signs. More particularly, the present invention relates to the field of collapsible billboard signs.

BACKGROUND OF THE INVENTION

Large signs, typically referred to as billboards, are located along the vast majority of roadways in the United States and many other countries. The signs typically carry advertising directed at the individuals passing by the sign. Because most of the billboards are located outdoors, they are exposed to wind damage during storms. The damage can be caused by the force of the wind alone, as well as from flying debris.

These structures are typically designed to withstand winds of 70–110 mph. In some locations, particularly those prone to hurricane-force winds, those structures are not adequate to prevent damage and/or destruction of the billboard and support frame during a hurricane, as winds can reach levels of 165 mph or greater. As a result, billboards in such areas are periodically destroyed as storms move through the areas.

The damage to billboards can be roughly separated into damage to the sign face itself, i.e., the portion of the billboard carrying the advertising message. Alternatively, the frame supporting the sign face and the support structure used to elevate the frame above the ground to facilitate viewing of the sign face can be damaged by the wind. In some instances, damage will be only to the sign face, leaving the frame and support structure intact. In other cases, the sign face and frame may be damaged, while the majority of the support structure remains in place. In the worst case scenario, the sign face, frame and support structure are all destroyed due to the force of the wind.

Because the sign face presents a relatively large surface area to the wind, as opposed to the frame and support structure, it is typically the root source of the damage to both the frame and support structure, particularly where the sign face is sturdy enough to transmit large portions of the wind energy to the frame and support structure before losing enough surface area to reduce the forces transmitted to the frame and support structure.

Loss of the frame and/or support structure can cause severe consequences. Many localities attempt to control/reduce the number and location of billboard signs by preventing owners from erecting new signs in place of those whose frame and/or support structure have been damaged beyond repair. Many of those locations are highly desirable due to traffic flow and other considerations. As a result, the owner can face a significant economic loss if the sign frame and support structure are damaged beyond repair and cannot be replaced, as that location will be lost for future advertising revenues.

As a result, many billboard owners resort to removing the panels of signs in the probable path of storms. That practice is, however, labor intensive, as well as being limited to those signs which are reached by removal crews before wind speeds exceed safe levels. In addition, the paths of many storms are not accurately predicted, resulting in the removal of signs which would have been safe and the failure to remove sign panels which are subsequently destroyed in the storms.

Attempts have been made to design billboard signs which minimize wind damage. Those attempts have included hinging the panels making up the sign face to allow them to rotate in response to wind forces. That design, however, suffers from a number of problems. First, it is difficult to construct a sign with rotatable panels which is aesthetically pleasing—an important consideration for signs carrying advertising material. Second, even though the sign is designed to rotate when the wind exceeds a predetermined force, the friction of air flowing over the surface of the hinged panels can provide enough force to damage the panels and/or the supporting frame and support structure in some instances. Finally, those designs are not compatible with the flexible sign faces being used on many billboards.

Another collapsible design includes hinged panels, the ends of which are guided into channels located at opposing side edges of the sign. When the sign is lowered, the panels are removed from the channels and stacked on the ground. Each of the sections or panels are located in a single plane when vertical. As a result, if high winds are being experienced when the sign is being lowered, it may be difficult and/or impossible to lower the sign, as the wind force may prevent the hinges from operating as desired. In addition, the sign is lowered only under force of gravity, which can increase the problems associated with lowering the sign during high winds. Furthermore, the design of the structure requires manual alignment of the sections in the channels at either end of the sign, thereby negating any opportunity to automate raising and lowering of the sign.

SUMMARY OF THE INVENTION

The present invention provides a collapsible sign, including a fixed frame, a plurality of sections hingedly and movably attached to the frame, and means for moving the sections between a viewing position and a collapsed position. Also included is means for positioning adjacent pairs of the plurality of sections to provide an offset distance between axes of rotation located at each end of each section when the plurality of sections are in the viewing position.

The offset distance between the axes of rotation at each end of the sections assist in moving the sign from the viewing to the collapsed position during periods of heavy winds by reducing the force needed to collapse the sign. The offset also biases the sections to rotate in the proper direction, thereby preventing jamming of the sections due to the force of the wind.

Another advantage of the present invention is its compatibility with flexible sign faces which are currently being used by many advertisers.

These and other various features and advantages of the present invention will be apparent upon a review of the detailed description of the preferred embodiment below. The invention is, however, to be limited only by the claims as they appear below.

BRIEF DESCRIPTION OF THE DRAWINGS

FIG. 4A is a perspective view of the top cross-beam and trolley assembly of a preferred embodiment of a sign according to the present invention.

FIG. 4B is an enlarged partial cross-sectional view of the trolley assembly of FIG. 4A taken along line 4B—4B.

DETAILED DESCRIPTION OF A PREFERRED EMBODIMENT

Figure 1A:
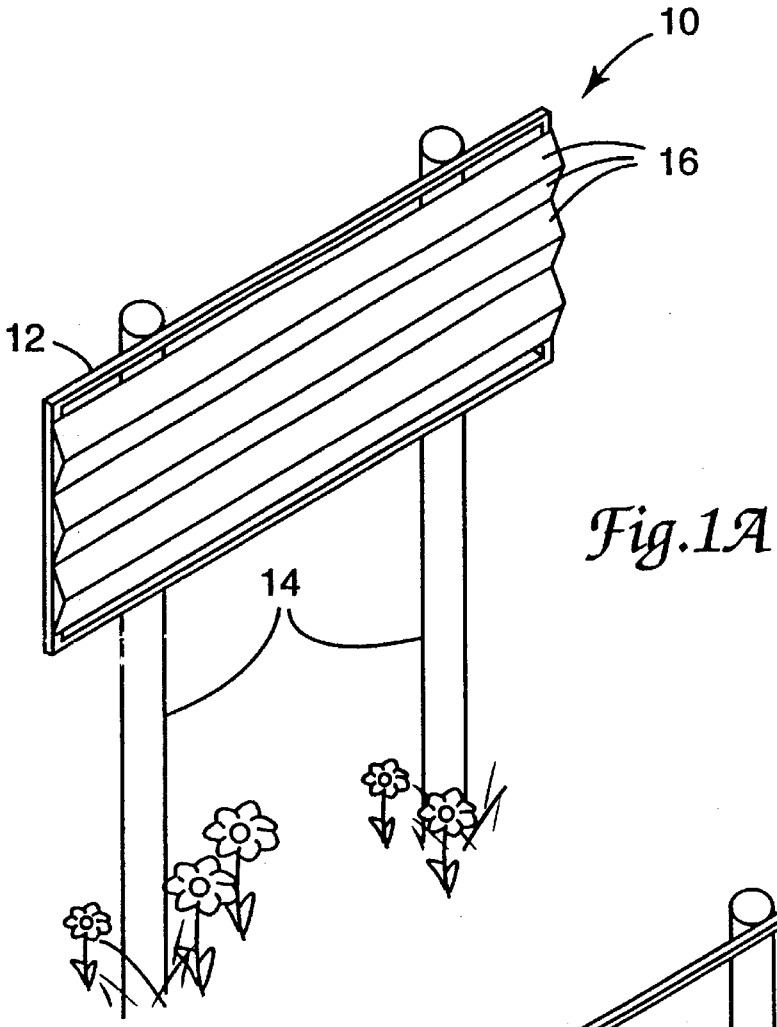
FIG. 1A is a perspective view of one preferred embodiment of a sign according to the present invention in the viewing position.

As shown in FIG. 1A, one preferred embodiment of a sign 10 according to the present invention includes a frame 12 supported above the ground by a support structure 14. The sign 10 includes a plurality of sections 16 which are attached to the frame 12.

In FIG. 1A, the sign 10 is shown in its viewing position in which the plurality of sections 16 are located substantially in a viewing plane. For the purposes of the present invention, the viewing plane is substantially vertical, although as described in more detail below, the sections 16 are, themselves, preferably not located in a single true plane. As used in connection with the present invention, the terms "horizontal" and "vertical" are with reference to level ground.

Figure 1B:
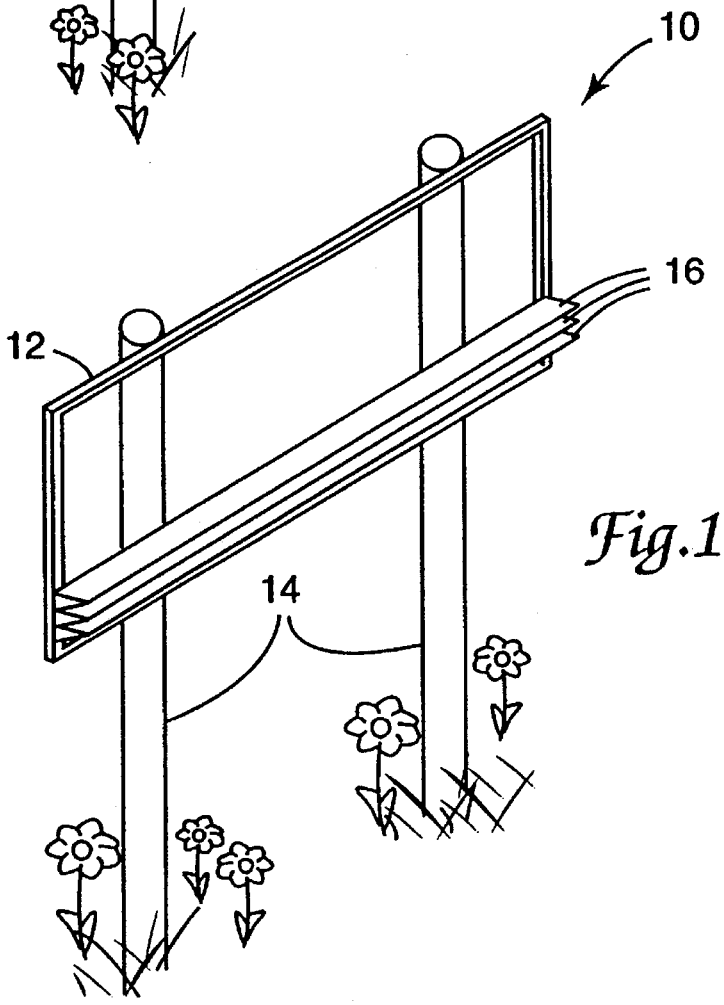
FIG 1B is a perspective view of the sign of FIG. 1A in the collapsed position.

Turning to FIG. 1B, the sign 10 is shown in its collapsed position in which the plurality of sections 16 are located at the bottom of the frame 12 and are preferably oriented generally parallel to each other. It is in the collapsed position depicted in FIG. 1B that a sign according to the present invention should be able to withstand significantly heavier winds than signs which cannot be collapsed because of the significantly reduced surface area of sign 10 in its collapsed position.

Although in the preferred embodiment, moving the sections 16 to the viewing position involves raising the sections 16 to the top of frame 12 while moving the sign 10 the collapsed position involves lowering sections 16 to the bottom of frame 12, alternate designs could include collapsing sections 16 at the top of frame 12, or providing a design in which sections 16 would be collapsed to one side of frame 12 (i.e., oriented 90° from sign 10 shown in FIGS. 1A and 1B).

Figure 2:
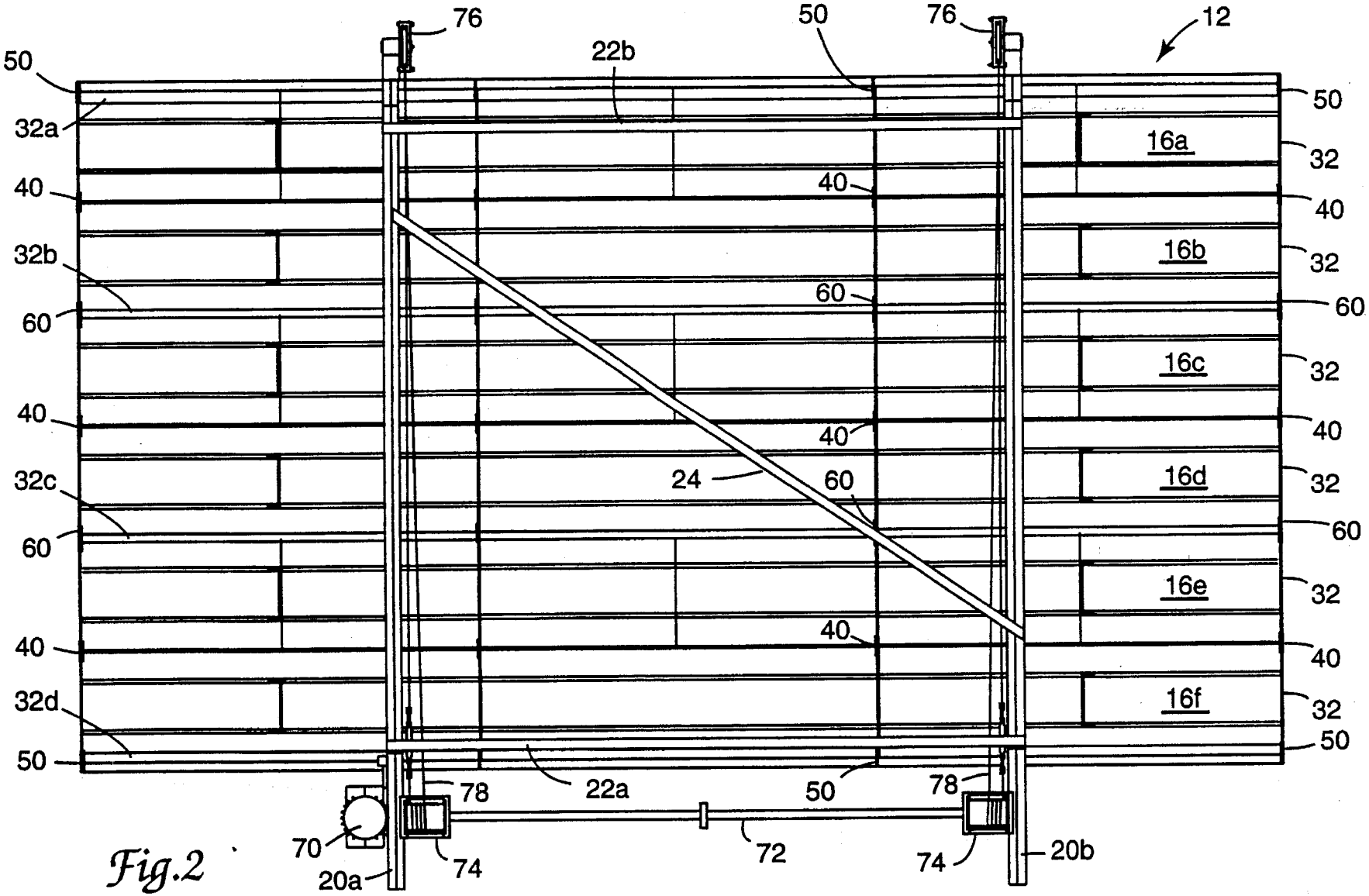
FIG. 2 is a rear, plan view of one preferred embodiment of a sign according to the present invention which is in the viewing position.

Turning now to FIG. 2, in which a rear plan view of one preferred sign 10 is depicted. Frame 12 includes two channels 20*a* and 20*b* located in a vertical plane and horizontal members 22*a* and 22*b* maintain proper spacing between channels 20*a* and 20*b*. Also included is bracing member 24 which preferably runs diagonally between channels 20*a* and 20*b* to further strengthen and provide additional rigidity to frame 12.

The sections 16*a*, 16*b*, 16*c*, 16*d*, 16*e* and 16*f* (generally referred to as 16) of sign 10 are shown in the viewing position in FIG. 2, i.e., they are all located in the viewing plane, which is generally vertical. Although the sections are shown as solid panels in FIG. 2, it will be understood that sections 16 could comprise a skeletal framework of members with no solid panel.

A series of four crossbeams, 30*a*, 30*b*, 30*c*, and 30*d* (generally referred to as 30) extend substantially horizontally along the length of each section 16. Each crossbeam 30 is preferably constructed of tubular steel member and, together the cross-beams 30 provide much of the rigidity to sign 10, as they serve as the primary points of attachment between sections 16 and frame 12, as will be described in greater detail below.

Each of the sections 16 is hingedly connected to its adjacent section(s) 16 as well as to one of the crossbeams 30. As shown in FIG. 2, the uppermost section 16 is hingedly connected to crossbeam 30*a* at four points by single hinges 50. At its bottom edge, uppermost section 16*a* is connected to its adjacent section 16*b* by a series of pivoting links 40 which will be described in greater detail below. Similarly, the bottom edge of section 16*b* is connected to crossbeam 30*b* by a series of hinges 60, which are also connected to the top edge of section 16*c*. The bottom edge of section 16*c* is connected to the upper edge of 16*d* by a series of links 40, while the lower edge of section 16*d* is connected to crossbeam 30*c* by a series of hinges 60. Hinges 60 on crossbeam 30*c* are also connected to the upper edge of section 16*e*, while the lower edge of section 16*e* is connected to the upper edge of section 16*f* by a series of links 40. Finally, the bottom section 16*f* is connected to the bottom cross-beam 30*d* by a series of single hinges 50.

Figure 3:
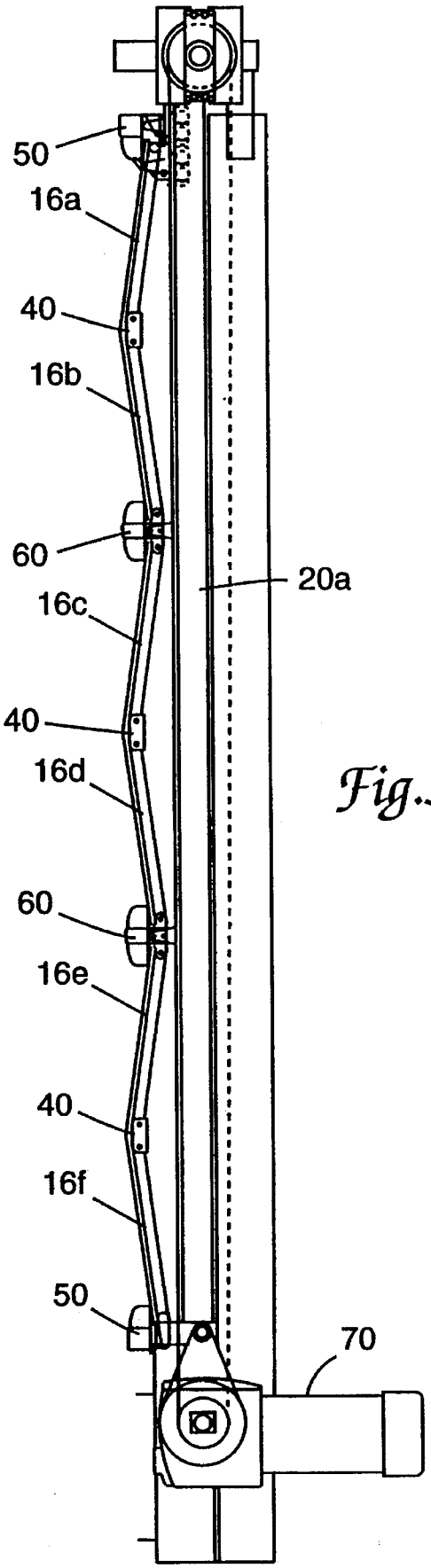
FIG. 3 is a side elevational view of the sign of FIG. 2.

The means for moving the sections 16 between the viewing position shown in FIGS. 2 and 3, and the collapsed position shown generally in FIG. 1B is, in the preferred embodiment, a pair of cables 78. A motor 70 drives axle 72 which is operatively connected to a pair of drums 74, around which cable 78 is wrapped. At the upper end of frame 12, each cable 78 is wrapped around a sheave 76. Each end of each of the cables 78 is fixedly connected to the top cross-beam 30*a* to move it between its position near the top of frame 12 in the viewing position, as well as its position near the bottom of frame 12 when sign 10 is in the collapsed position. It will be understood that the rate of travel of each cable 78 should be substantially equal to prevent binding when moving the sections 16 between the collapsed and viewing positions.

Connection between the cable 78 and crossbeam 30*a* can be made in any number of conventional means, although the preferred connection is accomplished by providing a clevis on each end of the cables 78 which is connected to lug welded onto cross-beam 30*a*. The preferred cable 78 also includes a turnbuckle to adjust the cable tension and compensate for stretch in the cables 78.

Although the preferred means for moving sections 16 between the viewing and collapsed positions is an endless cable assembly, it will be understood that many other means for moving the sections 16 could be substituted. Some examples include, but are not limited to, a screwdrive assembly, a chain drive, belt drive, etc.—all of which are preferably driven by a motor, but which may, alternately, be manually operated.

Furthermore, movement of the signs 10 between the viewing and collapsed positions can be initiated by appropriate controls on the signs 10, themselves or they could be initiated from remote locations using radio or other signalling technology. In yet another variation, the signs could include anemometers which initiate movement of the sign to the collapsed position when the wind speed reaches a predetermined level.

Regardless of the actual means chosen for moving the sections 16 between the viewing and collapsed positions, it is preferable that the sections 16 are driven in both directions. Driving the sections 16 into the collapsed position may be required during heavy winds in which the force of the wind may press panels 16 against frame 12, thereby preventing movement of sections 16 into the collapsed position under the force of gravity alone. It will, however, be understood that in areas where adequate notice of impending high winds is expected, the means for moving may not necessarily need to drive the sign 10 into the collapsed position. It will be understood, however, that in signs 10 which are not driven downward. it would be helpful to dampen the downward movement of the sign 10 to prevent damage.

Figure 5:
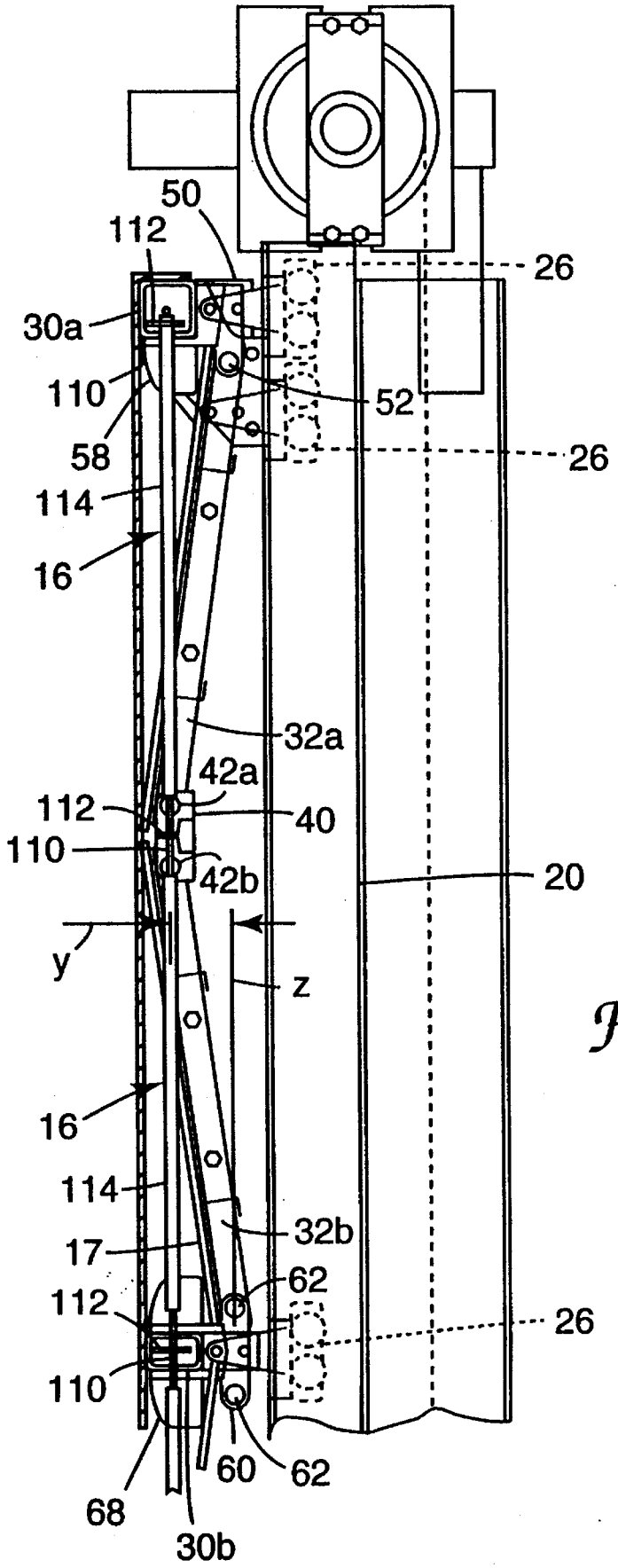
FIG. 5 is an enlarged side view of a portion of one preferred embodiment of a sign according to the present invention.

In the preferred embodiment, each of the crossbeams 30 is connected to both channels 20*a* and 20*b* (generally referred to as 20) in a manner which allows movement of the crossbeams 30 along channels 20. Referring now to FIGS. 4A and 4B, in the preferred embodiment each of the channels 20 includes a series of trolleys 26 which include wheels 27 mounted within channel 20 for movement along the channel, as well as a clevis 28 which is connected to an extension 34 of crossbeam 30. Pin 35 is used to connect the clevis 28 with extension 34. As best seen in FIG. 5, the top cross-beam 30*a* is attached to two trolleys 26 in the preferred embodiment to prevent binding during movement of cross-beam 30*a*.

As a result, as the cross-beams 30 and their associated sections 16 are moved between the viewing and collapsed positions, the trolleys 26 ensure that the cross-beams 30 move in the desired plane defined by channels 20. It will, of course, be understood that many other mechanisms could be used to movably connect cross-beams 30 to channels 20.

Turning now to FIG. 5, an enlarged partial side view of the structural members constituting sign 10, the design principle incorporated in the preferred embodiment of sign 10 can be best understood. Sections 16*a* and 16*b* of the sign 10 are ultimately movably attached to channels 20 through members 32*a* and 32*b* which are rotatably attached to top cross-beam 30*a* and the adjacent cross-beam 30*b*. Those cross-beams 30 are attached to and move along channels 20 on trolleys 26. Member 32*a* is attached to single hinge 50 proximate cross-beam 30*a* at pivot point 52. Member 32*b* is hingedly attached to double hinge 60 proximate cross-beam 30*b* at pivot point 62. In between cross-beams 30*a* and 30*b*, members 32*a* and 32*b* are hingedly connected to each other via link 40 which includes two pivot points 42*a* and 42*b*. Member 32*a* is pivotally connected to link 40 at pivot point 42*a* while member 32*b* is pivotally connected to link 40 at pivot point 42*b*.

Because members 32 define the ends of adjacent sections 16 forming sign 10, it will be understood that any rotation imparted to members 32 is also imparted to their respective sections 16. Furthermore, it will also be understood that the pivot points located at each end of the members 32 and respective sections 16 define the location of axes of rotation about which each section 16 rotates when moving between the viewing and collapsed positions.

To facilitate collapse of the sign 10, the axes of rotation defined by each of the pivot points at each end of the members 32 are offset with respect to a given axis z. In the preferred embodiment, the z axis shown in FIG. 5 is substantially parallel with the channels 20 in which trolleys 26 move. By virtue of the design of the preferred sign 10, axis z would extend through both pivot points 62 and 52, although that is not a requirement for the present invention. The critical dimension is y, the orthogonal offset distance between the pivot point 42*b* and the z axis when the sign 10 is in the viewing position. That offset determines the direction of rotation of each of the members 32 about their respective pivot points 52 or 62.

Figure 6:
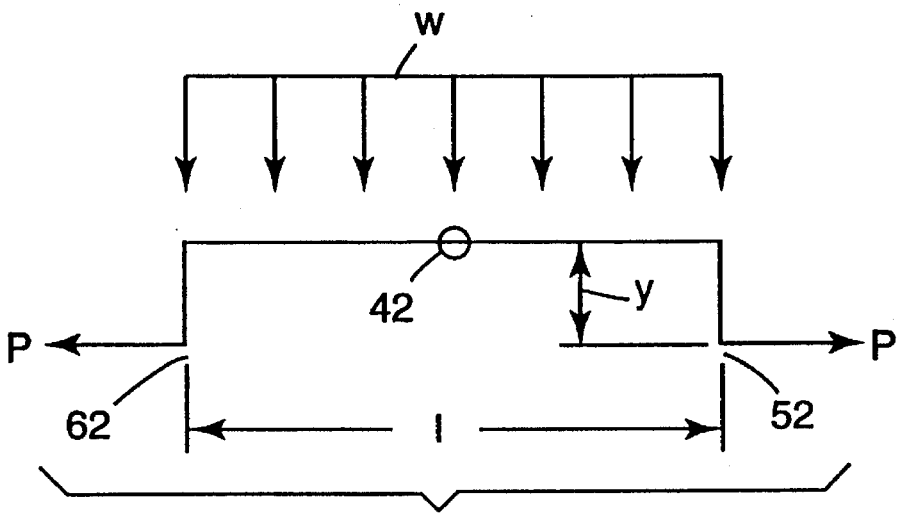
FIG. 6 is a force diagram depicting the forces operating on a model of a sign according to the present invention.

In addition, the offset distance is also useful for determining the force necessary to move the sign 10 from the viewing to the collapsed position in a given wind load. The force applied by a given wind load is transferred to the cables 78 via a diaphragm action. Each pair of sections 16 of sign 10 can be modeled as depicted in FIG. 6, where wind load (w) is shown acting on a pair of adjacent sections 16 in which the distance between supports, i.e., pivot points on a single or double hinge (52 or 62) is shown as l. At the midpoint, the sections 16 are connected at pivot point 42. As the wind load acts on sections 16, a diaphragm force P is transmitted to points 52 and 62 which can be extrapolated to the cable 78 in the preferred embodiment. As a result, it is the force P which must be overcome when moving the sign 10 from the viewing position to the collapsed position in a given wind load w.

Summing the moments about pivot point 42 yields the following equation for determining the diaphragm tension force:

$$P=wl^2/8y$$

From the above equation, it can be seen that increasing the offset distance y will reduce the force P needed to move the sign 10.

The offset distance y must be greater than zero to prevent binding of the sign 10 and to reduce the force needed to move the sign 10 between the viewing and collapsed positions. It is more preferred that the offset distance y is greater than about 1.5 inches (3.8 cm) and in the preferred embodiment of sign 10 described herein, the offset distance y is about 3.5 inches (8.9 cm).

In the preferred embodiment of sign 10, the offset distance y is provided by using a system of stop members located on the hinged portions of the sign 10 which limit the rotation of the sections 16, resulting in the desired amount of offset.

Figure 7A:
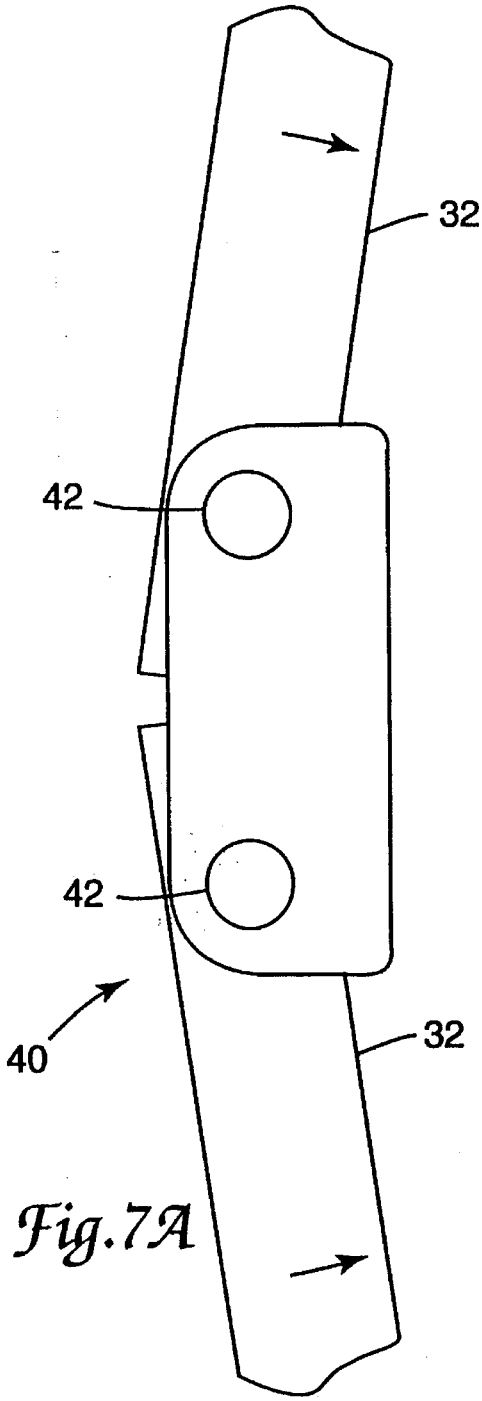
FIG. 7A is an enlarged side view of a link used to connect adjacent sections of the preferred embodiment of a sign according to the present invention.
Figure 7B:
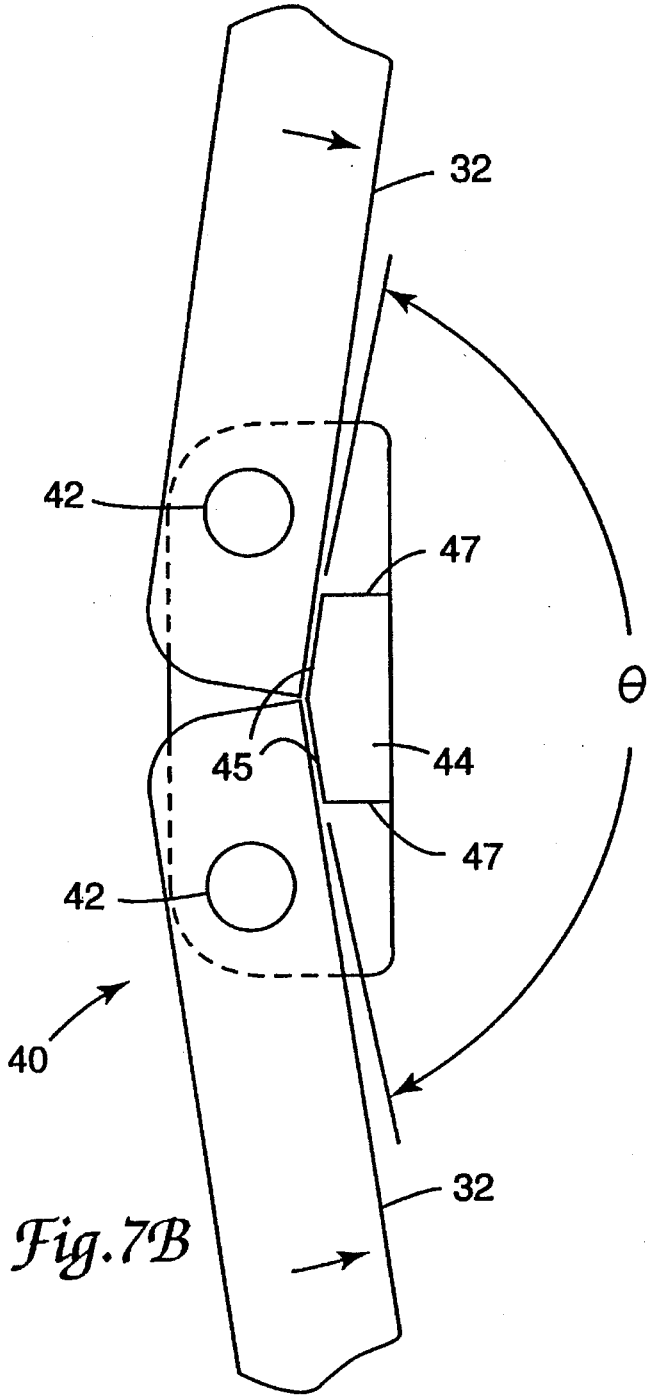
FIG. 7B is an opposite side view of the link of FIG. 7A.

Turning to FIGS. 7A and 7B, the links 40 used to connect adjacent pairs of sections 16 are shown enlarged for clarity. Each link 40 connects two members 32, each of which form a portion of one of the adjacent sections 16. Each link 40 includes two pivot points 42 around which one of the attached members 32 pivots. The pivot points 42 are preferably spaced apart.

Each preferred link 40 includes a stop member 44 with faces 45 which limit rotation of members 32 about pivot points 42 such that members 32 form an angle of θ when the sections 16 are in the viewing position. In the Preferred embodiment, the angle θ is less than 180°, with the specific angle being chosen in combination with the distance between pivot points on each of the members 32 to obtain the desired offset distance y. In the preferred embodiment, angle θ is about 164° which, when combined with members 32 having pivot points located 23.625 inches (60 cm) apart, translates into the desired offset of about 3.5 inches (8.9 cm) between the pivot points when measured according to a given axis z as described above.

By preventing each of the members 32 from forming an angle of 180°, each link 40 also prevents the corresponding panels 16 connected to members 32 from forming angles of 180° between them. This is critical to ensure movement of sections 16 from the viewing position to the collapsed position in the face of pressure from heavy winds. By biasing the panels 16 in a direction in which they will be folded in the collapsed position, the force necessary to achieve the collapsed position during heavy winds is significantly reduced as described above. Furthermore, the biasing is designed to prevent the sections 16 from being jammed in position by the pressures of heavy winds when those same sections 16 are desired to be moved to the collapsed position.

A further feature of each of the preferred links 40 are surfaces 47 on stop member 44. In the most preferred embodiment, each of these surfaces 47 limits rotation of members 32 beyond a predetermined angle when the sections 16 are moved into the collapsed position. In the preferred collapsed position, surfaces 47 limit the rotation of members 32 such that sections 16 lie in generally parallel planes when combined with hinges 60 and 50 as described in greater detail below. In the preferred embodiment, the angle formed between surfaces 47 and a line running through the centers of pivots 42 forms and angle of about 90°.

Figure 8:
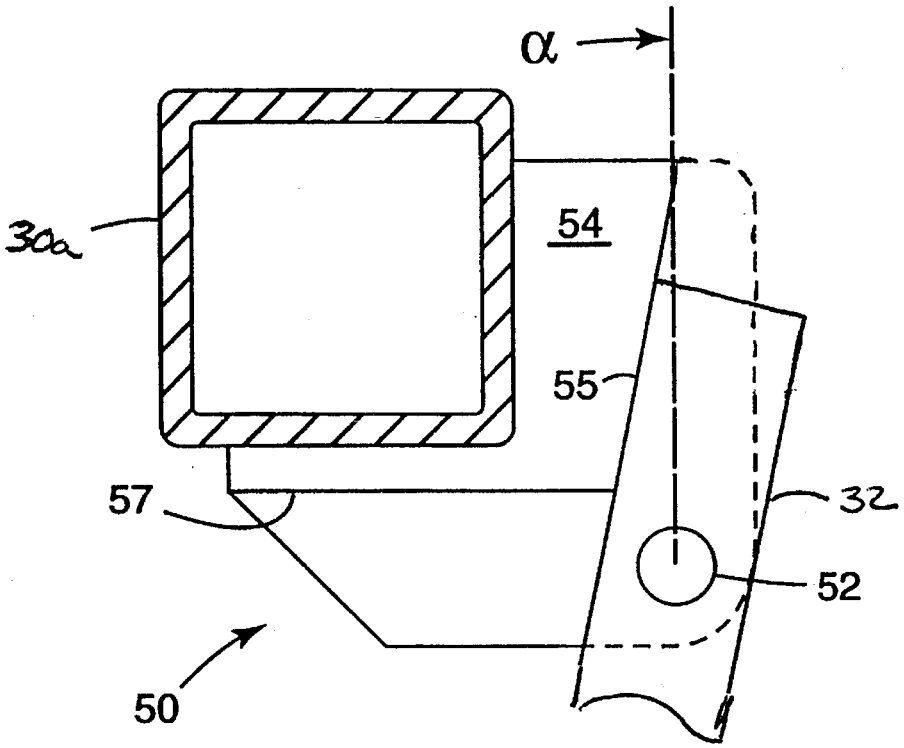
FIG. 8 is an enlarged side view of a single hinge used along a top or bottom cross-beam of a preferred embodiment of a sign according to the present invention.

Turning now to FIG. 8, where a single hinge 50 is depicted in an enlarged view. Single hinges 50 are referred to as "single" because they include only a single pivot point 52 to which a member 32 is attached. As with links 40, member 32 is a portion of each of the sections 16. As such, any rotation of member 32 is imparted to its corresponding section 16. Each preferred single hinge 50 is attached to a crossbeam 30, as shown in FIG. 8, by any suitable method including welding and/or mechanical fasteners.

Similar to the preferred links 40 described above, each of the single hinges 50 includes a stop member 54 designed to limit rotation of member 32 around pivot point 52. Stop surface 55 prevents rotation of member 32 to a fully vertical position. Rather, member 32 is located at an angle α off of an axis substantially parallel to the channels 20 in which trolleys 26 move. For the purposes of the preferred embodiment described herein, axis z is the same for single hinges 50 and can be used to measure the desired angle α. It is preferred that angle α be greater than 0°, with the specific angle being chosen in combination with the distance between pivot points on each of the members 32 to obtain the desired offset distance y. In the preferred embodiment, angle α is about 8° which, when combined with stop members 32 having pivot points located 23.625 inches (60 cm) apart, translates into the desired offset of about 3.5 inches (8.9 cm) between the pivot points when measured according to a given axis z as described above.

In addition, the preferred stop member 54 includes stop surface 57, which prevents rotation of member 32 and its corresponding sections 16 beyond an angle of about 90° with a vertical axis when the sign 10 and sections 16 are moved to the collapsed position.

Single hinge 50, depicted in FIG. 8, is particularly adapted for use on the top crossbeam 30*a*, as shown in FIG. 2. It will be understood that single hinges 50 located at the top of sign 10 will be mirror images of the hinge 50 depicted in FIG. 6 to impart the desired angular relationship to similar members 32 and their corresponding section 16*a*, as best shown in FIG. 3. As such, those single hinges 50 will not be separately described herein.

Figure 9:
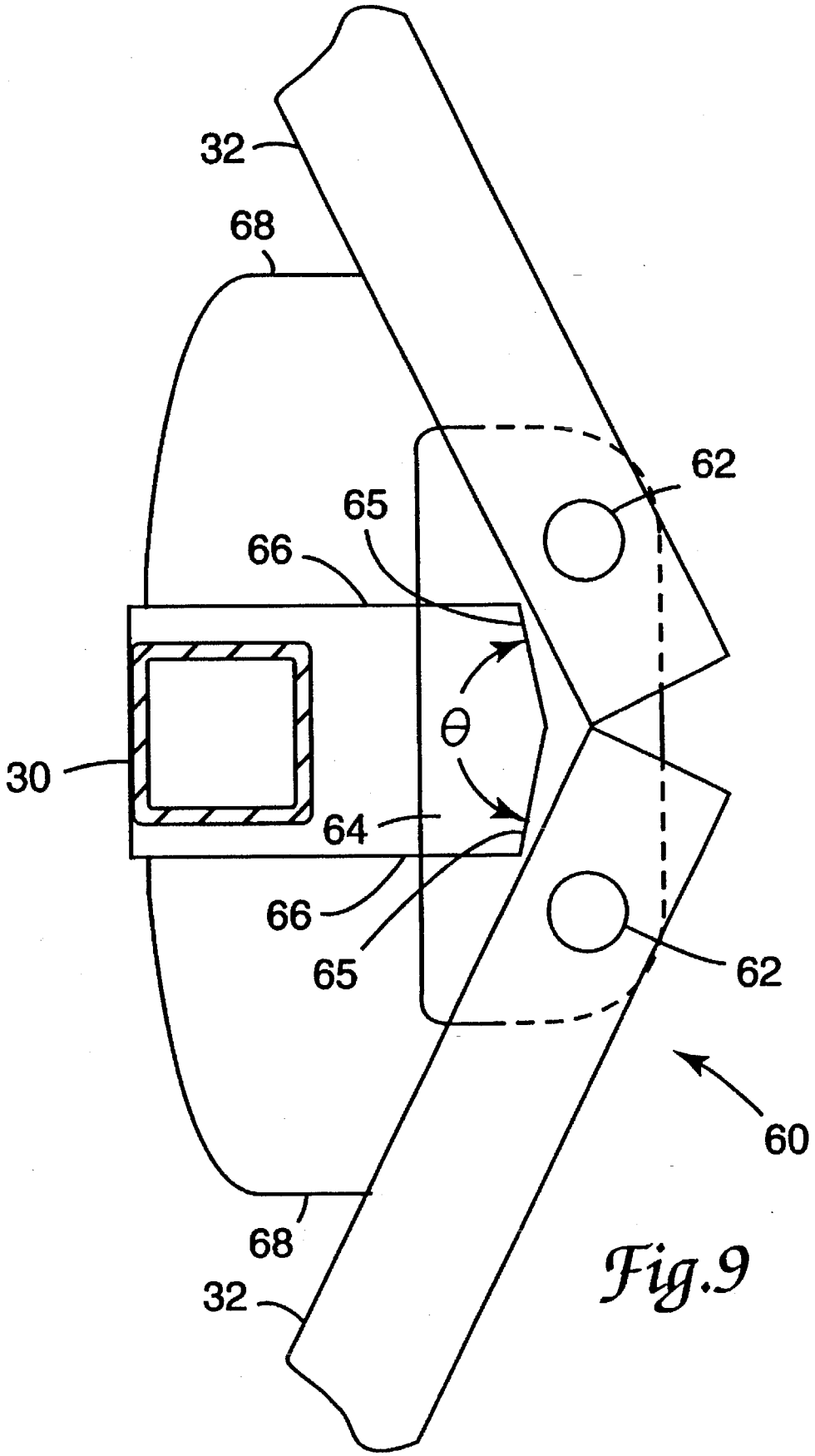
FIG. 9 is an enlarged side view of a double hinge used to connect adjacent sections of a preferred embodiment of a sign according to the present invention.

Crossbeams 30*b* and 30*c*, which are located between the upper cross-beam 30*a* and lower cross-beam 30*d*, will include a series of double hinges 60, depicted in FIG. 9. Hinges 60 are referred to herein as double hinges because they include a pair of pivot points 62 which are spaced apart from each other. A different member 32, each constituting a portion of adjacent sections 16, is pivotally connected to each of the pivot points 62.

Each of the double hinges 60 is preferably fixedly connected to a crossbeam 30 and also includes a stop member 64. Each stop member 64 includes two surfaces 65, which limit the rotation of members 32 at one end of rotation (when sections 16 are in the viewing position), such that the angle between both surfaces 65 and members 32, i.e., angle θ, is less than 180°, with the specific angle being chosen in combination with the distance between pivot points on each of the members 32 to obtain the desired offset distance y. In the preferred embodiment, angle θ is about 164° which, when combined with stop members 32 having pivot points located 23.625 inches (60 cm) apart, translates into the desired offset of about 3.5 inches (8.9 cm) between the pivot points when measured according to a given axis z as described above.

Stop member 64 also preferably includes two surfaces 66, which also limit the rotation of members 32 and their corresponding sections 16 at the opposite end of their rotation (when sections 16 are in the collapsed position), such that the angle between a line running through the centers of both pivot points 62 and members 32 does not exceed about 90°. As a result, the adjacent sections 16 lie stacked in substantially parallel planes when the sign 10 is in its collapsed position.

The means for positioning adjacent pairs of sections 16 to form an included angle of less than 180° when the sections 16 are in the viewing position has been described above as stop members incorporated into links 40, single hinges 50 and double hinges 60. It will be understood, however, that one alternative means for positioning could include stops located in appropriate positions on the frame 12 or elsewhere on sections 16 to accomplish the same function, i.e., limiting rotation of members 32 and their corresponding sections 16 to provide a desired offset distance y between pivot points at the ends of members 32.

Figure 10A:
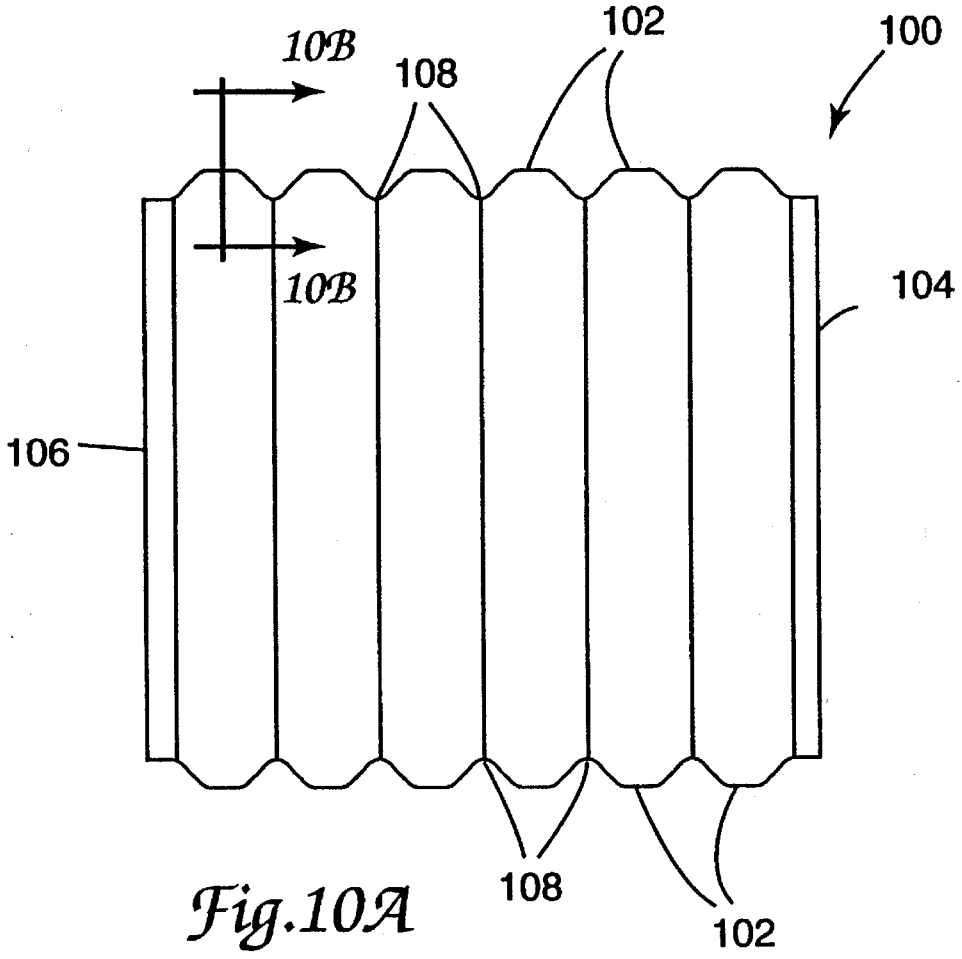
FIG. 10A is a plan view of a preferred embodiment of a flexible sign face useful on a collapsible sign according to the present invention.
Figure 10B:
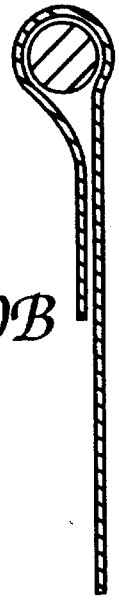
FIG. 10B is a partial cross-sectional view (enlarged) of a reinforced edge of the sign face of FIG. 10A taken along line 10B—10B.

Turning now to FIGS. 10A and 10B, a flexible sign face 100 is depicted in FIG. 10A in a flattened configuration. The flexible sign face 100 includes a top edge 104 and bottom edge 106, which, in the preferred embodiment of a sign 10 are attached to the top crossbeam 30*a* and bottom crossbeam 30*d*, respectively.

The side edges of flexible sign face 100, located between the top edge 104 and bottom edge 106, consist of a series of side edges 102 separated from each other by cutouts 108. In the preferred embodiment, each side edge 102 comprises a cylindrical member 103 located within a sleeve formed by folding and stitching the material constituting the flexible sign face 100. As depicted in cross-section in FIG. 10B, the flexible sign face 100 is folded over to contain the rod 103 in a sleeve.

That same construction used with the plurality of side edges 102 is also used along the entire length of edges 104 and 106, each of which contain at least one stiffening member to impart rigidity over the entire width of each of the top and bottom edges 104 & 106.

The flexible sign face 100 is preferably tensioned over sections 16, which together constitute sign 10. In the preferred embodiment, top edge 104 and bottom edge 106 are attached to the respective top and bottom crossbeams 30*a* and 30*d*. Extensions 102 are used to tension flexible sign face 100 individually along the sides of each of the sections 16, such that when the sign 10 is in its viewing position, flexible sign face 100 is sufficiently taut to reduce billowing of the flexible sign face 100. By providing stiffeners in the top and bottom edges 104 and 106 as well as in the side edges 102, tension can be applied uniformly over the length of the top and bottom edges 104 & 106 as well as over each of the side edges 102 corresponding to each of the sections 16.

Cutouts 108 are supplied to prevent folding and wrinkling of the flexible sign face material 100 when the sign 10 is in its collapsed position. Each of the cutouts 108 is located at the junctions between adjacent sections 16 which also correspond to the location of a link 40 or one of the hinges 50 or 60. In addition, each of the extensions 102 preferably wrap around at least the front edge of each section 16, so that when flexible sign face 100 is attached, a sign 10 in the viewing position presents a single, unbroken surface on which graphics can be presented.

The system described above for attaching the flexible sign face 100 to sign 10 will be understood as only one version of many which could be employed to adequately attach a flexible sign face to a sign 10 which can be moved from a viewing to a collapsed position within the terms of the present invention. Many other methods will be known to those skilled in the art.

Due to the angular relationship between sections 16 in the preferred embodiment of sign 10 as described above, it is preferred to include a means for providing a straight edge along both sides of sign 10. A straight edge facilitates attachment of flexible face 100 by providing an edge over which flexible face 100 can be folded without billowing or conforming to the angular offsets between sections 16, which could distort the message carried on flexible face 100.

In the preferred embodiment, the straight edge is provided by a cable 110 threaded through a series of eyelets 112 attached to each of the outermost single hinges 50, links 40 and double hinges 60 as best seen in FIG. 5. By tensioning cable 110 between the top cross-beam 30*a* and the bottom cross-beam 30*d* (not shown in FIG. 5) when the sign 10 is in its viewing position, a straight edge is provided over which flexible sign face 100 can be folded. In the preferred embodiment, sections of pipe 114 are provided between each of the eyelets 112 to provide additional rigidity to the straight edge provided by cable 110. It will be understood that the structure is similar on both sides of the preferred sign 10. Furthermore, many other mechanisms could be substituted in place of the preferred system to provide a straight edge along the sides of a sign 10 according to the present invention.

The construction of sign 10 as described above is particularly adapted for use with a flexible sign face such as 100 described above. Such sign faces provide a number of advantages over rigid sign faces. A flexible sign face 100 can be reused by using both sides for graphics and, in addition, new images can be applied over an existing image. Indeed, some flexible sign faces can be used for up to six or more different messages before being discarded. Shipping flexible sign faces is also easier than shipping the comparable pieces needed for a rigid sign face as the flexible sign face can be rolled up and is substantially lighter than a corresponding rigid sign face.

The double pivot points 42 and 62 provided on the links 40 and double hinges 60 are particularly well-suited for use with flexible sign faces. The double pivots 42 provided in each link 40 prevent the flexible sign face 100 from being stretched when the sign 10 is moved to its collapsed position. The double pivots 62 in each of the double hinges 60 also help prevent pinching of the sign face 100 when the sign 10 is moved to its collapsed position.

Referring back to FIG. 9, an additional feature provided in the preferred embodiment are spacers 68 which are preferably provided proximate each of the double hinges 60 to prevent pinching of a flexible sign face 100 when sign 10 is moved to the collapsed position. In the most preferred embodiment, each of the spacers 68 is also covered by a flap of flexible material to reduce abrasions to the flexible sign face 100 when the sign 10 is moved between the viewing and collapsed positions. The flap is preferably attached to the face of each of the sections 16.

Figure 11:
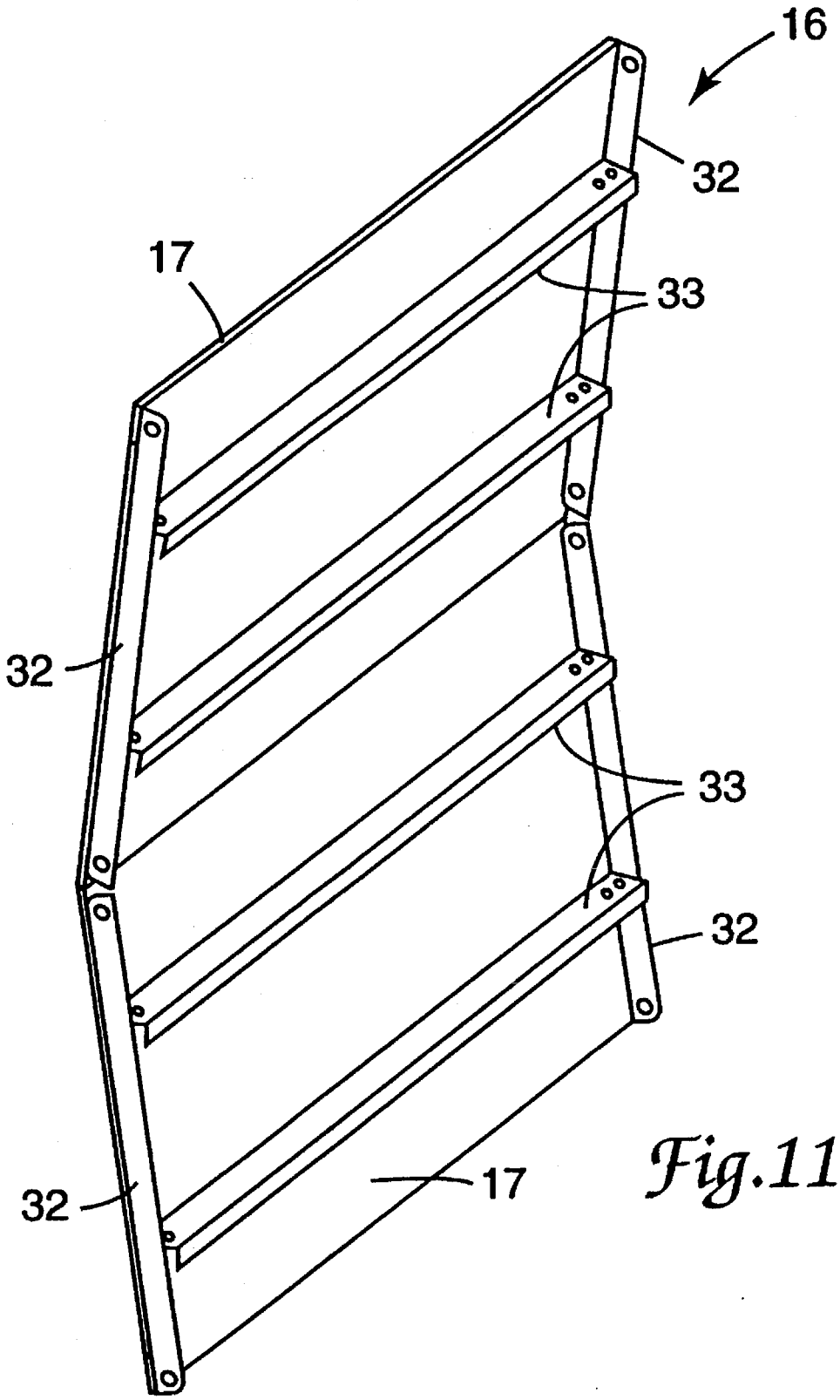
FIG. 11 is a perspective view of a portion of a section of one preferred embodiment of a sign according to the present invention.

FIG. 11 presents a perspective view of a portion of a section 16 in a preferred embodiment of sign 10 incorporating a flexible sign face 100. Each of the sections 16 includes a solid panel 17 attached to members 32 which span the distance between a single hinge 50 and link 40 or between a double hinge 60 and link 40 as described above. Each panel 17 is also supported by cross-members 33 which run between members 32.

Each panel 17 serves multiple purposes. First, the panel 17 prevents wind from directly striking the back side of flexible sign face 100, thereby causing it to billow. Second, the panel 17 preferably limits light transmission through the flexible sign face 100 to present the sharpest images possible to viewers, regardless of the position of the sun. In the most preferred embodiment, panel 17 is opaque, although translucent panels 17 may also sufficiently limit light transmission.

The space between each of the panels 17 in adjacent sections 16 is preferably minimized in the preferred embodiment to best accomplish the purposes set out above. In the most preferred embodiment, the panels 17 would overlap or abut each other to completely block the wind and light.

Although the preferred embodiment described above utilizes a flexible sign face 100, it will be understood that the principles used to construct the sign could be easily applied to signs which do not use flexible sign faces. The concept of providing an offset between the axes of rotation at the top and bottom of each section of the sign when in the viewing position to facilitate movement of the sign to a collapsed position could also be applied to a sign which presented a completely or substantially planar, unbroken rigid panel face when in the viewing position. As such, the present invention should not be limited to signs including flexible sign faces.

Whether used with a flexible or rigid sign faces, collapsible signs according to the present invention also provide potential advantages when a sign face is to be replaced. Because the sections 16 constituting the sign 10 can be lowered to the bottom of the frame 12, replacement of the sign face can be simplified by eliminating the need for workers to climb to the top of the sign 10. Rather, each section 16 can be replaced individually as the sign is raised or lowered.

It is to be understood that even though numerous characteristics and advantages of the present invention have been set forth in the foregoing description, together with details of the structure and function of a preferred embodiment of the invention, the disclosure is illustrative only, and changes may be made in detail, especially in matters of shape, size and arrangement of parts within the principles of the invention to the full extent indicated by the broad general meaning of the terms in which the appended claims are expressed.

We claim:

1. A collapsible sign comprising:

a) a substantially upright frame having a viewing side and a rear side, the frame comprising a plurality of channels lying in a first plane;

b) a plurality of sections located in front of the channels, each of the plurality of sections being hingedly and movably attached to the channels by a plurality of rollers attached proximate a first end of the section, each of the plurality of sections rotating about a first axis of rotation located proximate the first end of each of the plurality of sections, each Of the first axes of rotation located in front of the channels, and further wherein each of the plurality of sections is also hingedly attached to an adjacent section along a second axis of rotation proximate a second end of each of the plurality of sections, the second axis of rotation also being located in front of the channels;

c) means for moving the plurality of sections between a viewing position wherein the plurality of sections lie substantially parallel to the first plane, and a collapsed position wherein the plurality of sections are rotated and stacked in planes substantially orthogonal to the first plane, and further wherein the first end of each of the plurality of sections is proximate and in front of the channels and the second end of each of the plurality of sections is located distal from and in front of the channels when in the collapsed position; and d) means for positioning each of the plurality of sections to provide a predetermined offset distance between the first and second axes of rotation of each of the plurality of sections when the plurality of sections are in the viewing position, wherein the second axes of rotation are located in front of the first plane and the first axes of rotation.

2. An apparatus according to claim 1, wherein the means for positioning provides an offset distance of at least about 1.5 inches between the first and second axes of rotation when the sign is in the viewing position.

3. An apparatus according to claim 1, wherein the means for positioning provides an offset distance of at least about 3.5 inches between the first and second axes of rotation when the sign is in the viewing position.

4. An apparatus according to claim 1, further comprising a plurality of hinges located between adjacent sections of the plurality of sections and further wherein the means for positioning comprises a stop on at least one of the plurality of hinges located between adjacent sections of the plurality of sections.

5. An apparatus according to claim 1, wherein the means for positioning comprises at least one stop on the frame limiting the rotation of each of the plurality sections.

6. An apparatus according to claim 1, wherein each of the plurality of sections further comprises a substantially planar panel.

7. An apparatus according to claim 1, wherein the panels in adjacent sections of the plurality of sections abut.

8. An apparatus according to claim 1, wherein each of the plurality of sections further comprises a substantially planar panel having a front surface facing the viewing side of the frame and a back surface facing the rear side of the frame, and further wherein the front surfaces of the panels are located in front of the first plane.

9. An apparatus according to claim 1, further comprising a substantially flexible sign face attached to the plurality of sections, wherein the sign face lies substantially parallel to the first plane when the plurality of sections are in the viewing position, and further wherein the flexible sign face is folded between the adjacent pairs of the plurality of sections when the plurality of sections are in the collapsed position.

10. An apparatus according to claim 9, wherein the means for positioning provides an offset distance of at least about 1.5 inches between the first and second axes of rotation when the sign is in the viewing position.

11. An apparatus according to claim 9, wherein the means for positioning provides an offset distance of at least about 3.5 inches between the first and second axes of rotation when the sign is in the viewing position.

12. An apparatus according to claim 9, further comprising a plurality of hinges located between each of the adjacent sections and further wherein the means for positioning comprises a stop on at least one of the plurality of hinges located between each of the adjacent pairs of the plurality of sections.

13. An apparatus according to claim 9, wherein the means for positioning comprises at least one stop on the frame limiting the rotation of each of the plurality sections.

14. An apparatus according to claim 9, wherein each of the plurality of sections further comprises a substantially planar panel.

15. An apparatus according to claim 14, wherein the panels in adjacent sections of the plurality of sections abut.

16. An apparatus according to claim 9, wherein the sign face is located in front of the first plane.

17. A collapsible sign comprising:

a) a substantially upright frame having a viewing side and a rear side, the frame comprising a plurality of channels lying in a first plane;

b) a plurality of sections located in front of the channels, each of the plurality of sections being hingedly and movably attached to the channels by a plurality of rollers attached proximate a first end of the section, each of the plurality of sections rotating about a first axis of rotation located proximate the first end of each of the plurality of sections, each of the first axes of rotation located in front of the channels, and further wherein each of the plurality of sections is also hingedly attached to an adjacent section along a second axis of rotation proximate a second end of each of the plurality of sections, the second axis of rotation also being located in front of the channels;

c) means for moving the plurality of sections between a viewing position wherein the plurality of sections lie substantially parallel to the first plane, and a collapsed position wherein the plurality of sections are rotated and stacked in planes substantially orthogonal to the first plane, and further wherein the first end of each of the plurality of sections is proximate and in front of the channels and the second end of each of the plurality of sections is located distal from and in front of the channels when in the collapsed position; and d) a plurality of hinges located between each of the adjacent sections; and e) means for positioning each of the plurality of sections to provide a predetermined offset distance between the first and second axes of rotation of each of the plurality of sections when the plurality of sections are in the viewing position, wherein the means for positioning comprises a stop on at least one of the plurality of hinges located between each of the adjacent pairs of the plurality of sections, and further wherein the second axes of rotation are located in front of the first plane and the first axes of rotation.

18. An apparatus for raising and lowering a sign comprising:

a) a substantially upright frame having a viewing side and a rear side, the frame comprising a plurality of channels lying in a first plane;

b) a plurality of sections located in front of the channels, each of the plurality of sections being hingedly and movably attached to the channels by a plurality of rollers attached proximate a first end of the section, each of the plurality of sections rotating about a first axis of rotation located proximate the first end of each of the plurality of sections, each of the first axes of rotation located in front of the channels, and further wherein each of the plurality of sections is also hingedly attached to an adjacent section along a second axis of rotation proximate a second end of each of the plurality of sections, the second axis of rotation also being located in front of the channels;

c) means for moving the plurality of sections between a viewing position wherein the plurality of sections lie substantially parallel to the first plane, and a collapsed position wherein the plurality of sections are rotated and stacked in planes substantially orthogonal to the first plane, and further wherein the first end of each of the plurality of sections is proximate and in front of the channels and the second end of each of the plurality of sections is located distal from and in from of the channels when in the collapsed position; and d) a plurality of hinges located between each of the adjacent sections;

e) means for positioning each of the plurality of sections to provide a predetermined offset distance between the first and second axes of rotation of each of the plurality of sections when the plurality of sections are in the viewing position, wherein the means for positioning comprises a stop on at least one of the plurality of hinges located between each of the adjacent pairs of the plurality of sections, and further wherein the second axes of rotation are located in front of the first plane and the first axes of rotation; and f) a substantially flexible sign face attached to the plurality of sections, wherein the sign face lies substantially within a second vertical plane when the plurality of sections are in the viewing position, and further wherein the sign face is folded between adjacent pairs of the plurality of sections when the plurality of sections are in the collapsed position.

19. A collapsible sign comprising:

a) a substantially upright frame comprising a plurality of channels lying in the first plane;

b) at least one pair of adjacent sections, each of the sections having first and second ends, the first and second ends of each of the sections being located on opposing edges of each of the sections, wherein the first end of each section of each pair of the adjacent sections is hingedly and movably attached to the channels by a plurality of rollers, each section rotating about a first axis proximate the first end of each section;

c) a linkage rotatably connecting the second ends of each pair of adjacent sections, the linkage defining two spaced-apart pivot points, each of the pivot points defining second axes of rotation about which each section of the adjacent sections rotate;

c) means for moving the sign between a viewing position wherein each of the pairs of sections lie substantially parallel to the first plane, and a collapsed position wherein the plurality of sections are rotated and stacked in planes substantially orthogonal to the first plane;

d) means for positioning each section to provide a predetermined offset distance between the first and second axes of rotation of each section when the sign is in the viewing position; and f) a flexible sign face attached to the sections, wherein the sign face lies substantially within a vertical plane when the sign is in the viewing position, and further wherein the sign face is folded between each of the pairs of adjacent sections when the sign is in the collapsed position.

20. An apparatus according to claim 19, wherein the sign face is located in front of the first plane defined by the channels.

21. An apparatus according to claim 19, wherein the means for positioning provides an offset distance of at least about 1.5 inches between the first and second axes of rotation when the sign is in the viewing position.

22. An apparatus according to claim 19, wherein the means for positioning provides an offset distance of at least about 3.5 inches between the first and second axes of rotation when the sign is in the viewing position.

* * * * *